US009799976B2

(12) United States Patent
Lehner et al.

(10) Patent No.: US 9,799,976 B2
(45) Date of Patent: Oct. 24, 2017

(54) PIN CONTACT COMPRISING A CONTACT BODY PRODUCED AS A STAMPED BENT PART AND A SOLID CONTACT PIN

(71) Applicant: Tyco Electronics AMP GmbH, Bensheim (DE)

(72) Inventors: Antonio Lehner, Nauheim (DE); Volker Seipel, Bensheim (DE); Harald Kraenzlein, Schopfloch (DE)

(73) Assignee: TE Connectivity Germany GmbH, Bensheim (DE)

( * ) Notice: Subject to any disclaimer, the term of this patent is extended or adjusted under 35 U.S.C. 154(b) by 16 days.

(21) Appl. No.: 14/547,649

(22) Filed: Nov. 19, 2014

(65) Prior Publication Data

US 2015/0140876 A1 May 21, 2015

(30) Foreign Application Priority Data

Nov. 19, 2013 (DE) ..... 10 2013 223 570

(51) Int. Cl.

| | |
|---|---|
| ***H01R 13/02*** | (2006.01) |
| ***H01R 13/04*** | (2006.01) |
| ***H01R 43/16*** | (2006.01) |
| *H01R 13/17* | (2006.01) |
| *H01R 43/02* | (2006.01) |

(52) U.S. Cl.

CPC ..... *H01R 13/04* (2013.01); *H01R 43/16* (2013.01); *H01R 13/17* (2013.01); *H01R 43/0221* (2013.01)

(58) Field of Classification Search

CPC ..... H01R 13/432; H01R 13/24
USPC ..... 439/874, 891
See application file for complete search history.

(56) References Cited

U.S. PATENT DOCUMENTS

| | | | | |
|---|---|---|---|---|
| 5,888,107 A * | 3/1999 | Seymour | H01R 13/04 | 439/866 |
| 6,290,556 B1 * | 9/2001 | Howland | H01R 4/188 | 439/879 |
| 7,976,351 B2 * | 7/2011 | Boemmel | H01R 13/432 | 439/748 |
| 2006/0141874 A1 * | 6/2006 | Lenoir | B23K 37/0443 | 439/874 |

(Continued)

FOREIGN PATENT DOCUMENTS

| | | |
|---|---|---|
| DE | 7035873 | 6/1971 |
| DE | 3023232 C2 | 4/1990 |
| DE | 19924522 A1 | 11/2000 |

(Continued)

OTHER PUBLICATIONS

German Office Action, dated Jul. 9, 2014, 4 pages.
Japanese Patent Abstract for JP08037051A, date of publication Jun. 2, 1996, 1 page.

*Primary Examiner* — Abdullah Riyami
*Assistant Examiner* — Nader Alhawamdeh
(74) *Attorney, Agent, or Firm* — Barley Snyder

(57) ABSTRACT

A pin contact for an electrical connector is disclosed having a contact body and a pin. The contact body is formed from a metal sheet and has a mating end, a pin receiving space and an offset wall. The pin receiving space extends inward from the mating end. The offset wall has at least one welding region, and an outer surface facing away from the welding region and accessible from the outside. The pin is positioned in the pin receiving space and projects out of the mating end. The pin is welded to the welding region.

14 Claims, 4 Drawing Sheets

(56) References Cited

U.S. PATENT DOCUMENTS

2013/0273790 A1* 10/2013 Jakoplic ..... H01R 13/17
439/891

FOREIGN PATENT DOCUMENTS

| | | | |
|---|---|---|---|
| JP | 08037051 | | 2/1996 |
| WO | 2008042080 | A1 | 4/2008 |
| WO | 2008125922 | A1 | 10/2008 |

* cited by examiner

PIN CONTACT COMPRISING A CONTACT BODY PRODUCED AS A STAMPED BENT PART AND A SOLID CONTACT PIN

CROSS-REFERENCE TO RELATED APPLICATION

This application claims priority under 35 U.S.C. §119(a)-(d) to German Patent Application No. 10 2013 223 570.4, filed on Nov. 19, 2013.

FIELD OF THE INVENTION

The invention is generally related to an electrical connector, and more specifically, to a pin contact for an electrical connector.

BACKGROUND

Pin contacts are used commonly used in multi-pole connectors. Pin contacts generally have an elongated pin extending along an insertion direction. The pin contacts are receiving in a corresponding mating connector having a complementary pin contact receiving space. The inserted pin contact engages a mating contact terminal to establish an electrical connection. Pin contacts, in particular those the contact pins of which have cross-sectional widths of 0.5 mm or less, are generally produced from solid bodies by machining processes. These machining processes are often cost-intensive and produce excessive manufacturing waste.

There is a need for a pin contact that can be produced quickly and inexpensively, but that offers a sufficiently high degree of stability for the repeated joining and releasing of connectors, even when the pin contact has a small cross-sectional width.

SUMMARY

A pin contact for an electrical connector has a contact body and a pin. The contact body is formed from a metal sheet and has a mating end, a pin receiving space and an offset wall. The pin receiving space extends inward from the mating end. The offset wall has at least one welding region, and an outer surface facing away from the welding region and accessible from the outside. The pin is positioned in the pin receiving space and projects out of the mating end. The pin is welded to the welding region.

BRIEF DESCRIPTION OF THE DRAWINGS

The invention will now be described by way of example, with reference to the accompanying Figures, of which.

DETAILED DESCRIPTION

Figure 1:
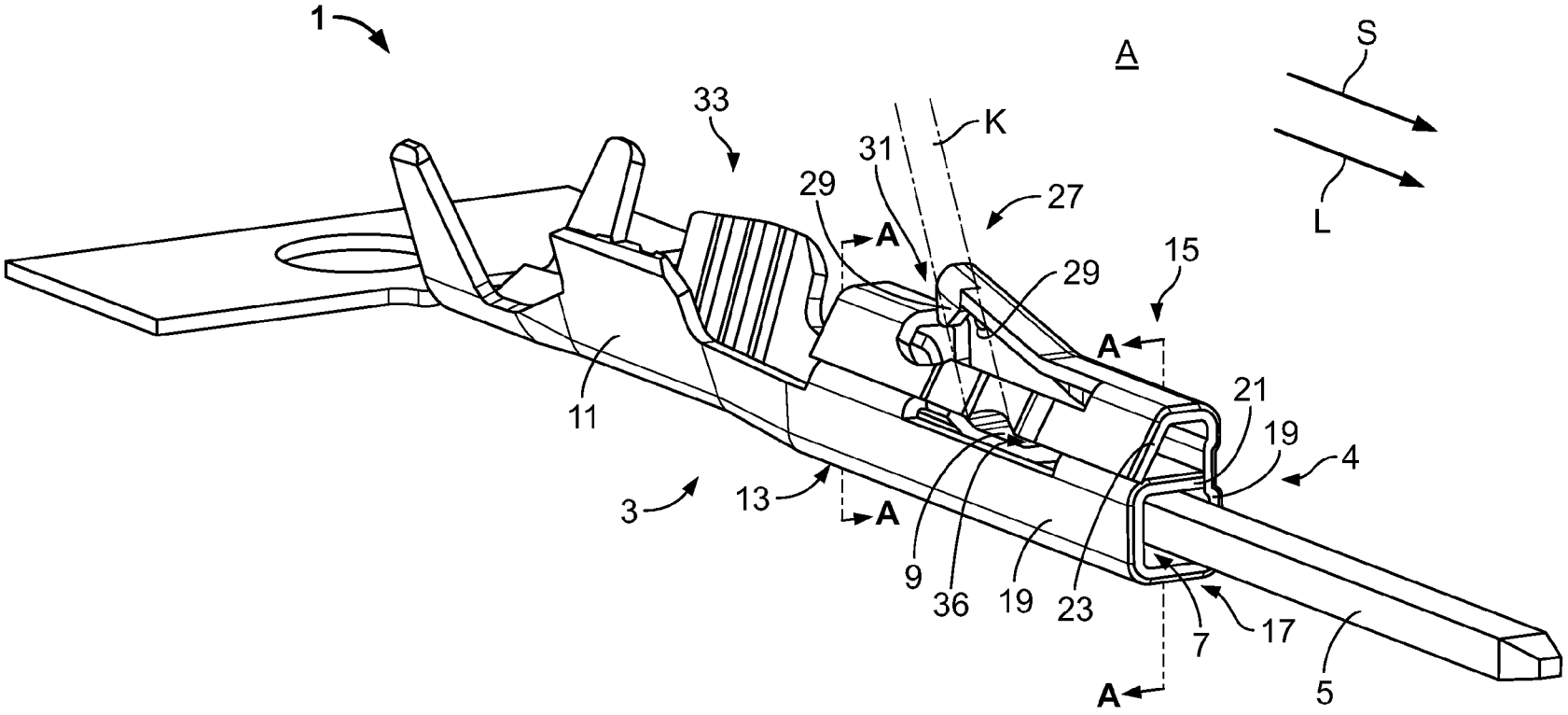
FIG. 1 is a perspective view of a pin contact with a reinforcing bridge.

In the embodiments of FIGS. 1-7, a pin contact 1 is elongated, extending along a longitudinal axis L, parallel to an insertion direction S. The pin contact 1 has a contact body 3 made from stamped and bent metal sheet 11, and a pin 5. The pin 5 is positioned in a pin receiving space 7 of the contact body 3, extending into the pin receiving space 7 from a mating end 4 of the contact body 3. A conductor receiving end is positioned on an opposite end from the mating end 4 along the longitudinal axis L. The pin 5 is welded at a welding region 35 to an offset wall 9 positioned in the pin receiving space 7. An outer surface 36 of the offset wall 9 faces outward, away from a welding region 35, and is accessible from the outside A through a tool receiving channel K. The region around the weld point is described in more detail below, with reference to FIGS. 2 and 3.

The contact body 3 is formed from the metal sheet 11 by stamping and bending, having a base wall 13 on a first side. A second side 15 of the contact body 3 is opposite the base wall 13. The base wall 13 includes a central region 17 having a pair of opposing sidewalls 19 bent approximately perpendicular from the base wall 13, and extending towards the second side 15. On the second side 15, a second inner wall 21 extends orthogonally from one sidewall 19 towards the other opposing sidewall 19, and a second outer wall 23 extends orthogonally from the opposing sidewall 19 towards the other opposing sidewall 19 towards the one sidewall 19, such that the pair of sidewalls 19 overlaps. The offset wall 9 is formed from a portion of the second inner wall 21, extending approximately parallel with the base wall 13 along the longitudinal axis L. Taken together, the base wall 13, the pair of sidewalls 19, and the second inner wall 21 form the pin receiving space 7. The second inner and outer walls 21 and 23 are formed from opposite end sections 59 of the metal sheet 11.

The outer wall 23 is spaced apart from and positioned a distance away from the second inner wall 21, and has a cantilevered arm 25. The cantilevered arm 25 has a connecting end (not labeled) and an opposite free end 27 extending against the insertion direction S and obliquely outward. The cantilevered arm 25 is elastically displaceable towards the base wall 13. The free end 27 has limiting protrusions 29 extending from an inner facing surface of the free end 27 towards the base wall 13. The limiting protrusions 29 control the degree of displacement of the cantilevered arm 25 towards the base wall 13. The limiting protrusions 29 are positioned over the second inner wall 21 of the contact body 3 such that when the cantilevered arm 25 is displaced towards the base wall 13, the limiting protrusions 29 contact the second inner wall 21 at a maximum displacement. In this way deformation of the cantilevered arm 25 is prevented when the cantilevered arm 25 is displaced. When viewed along the longitudinal axis, the free end 27 with the two limiting protrusions 29 form a U-shaped profile, and together form a positioning surface 31 of the free end 27.

The contact body 3 has a conductor connecting portion 33 on the conductor receiving end for connecting the contact body 3 to an electric conductor (not shown), such as for example a cable. Attachment of the conductor may be through crimping or any other attachment mechanism known to those of ordinary skill in the art.

Figure 2:
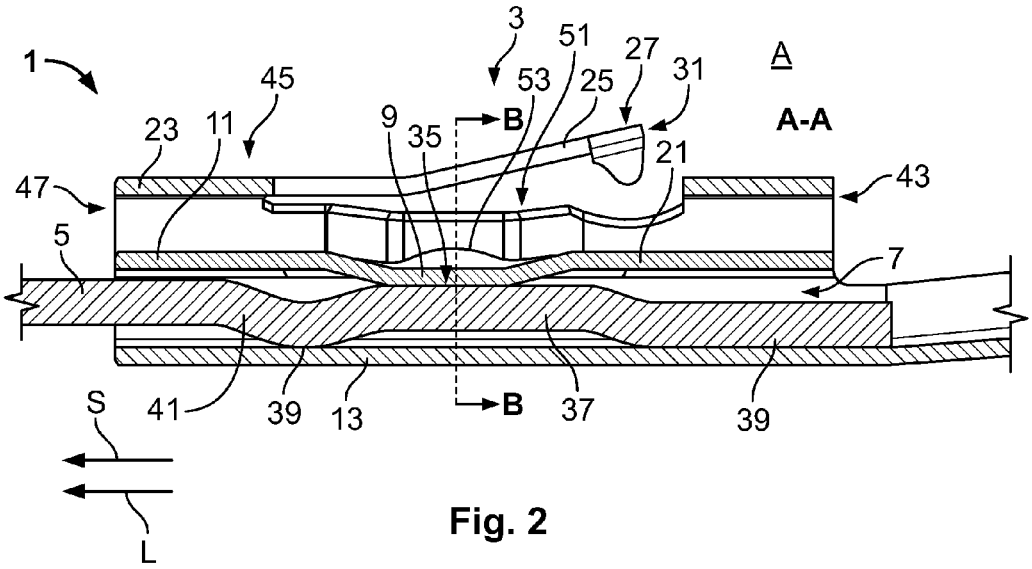
FIG. 2 is a cross-sectional view of the pin contact in FIG. 1 and a contact body, taken along the line A-A.

In the embodiment of FIG. 2, the pin 5 is positioned in the pin receiving space 7 and abuts against the offset wall 9 in the welding region 35. In order to enable a good seat of the pin 5 in the pin receiving space 7, the pin 5 has an offset portion 37 positioned in the welding region 35. The offset portion 37 extends towards the offset wall 9. Generally, when the pin 5 is positioned in the pin receiving space 7, the metal of the metal sheet 11 and the material of the pin 5 are sufficiently elastic so that the offset portion 37 of the pin 5 and/or the offset wall 9 elastically press against one another because at least one of the two is deformed elastically away from the other. In this way the pin 5 is held securely in the pin receiving space 7 before welding and a good electrical contact is produced between the pin 5 and the contact body 3, both in the region of the welding region 35, where the offset wall 9 contacts the offset portion 37 of the pin 5, and on lower contacting portions 39 of the pin 5 that rest against the base wall 13 of the contact body 3. In an embodiment, the pin 5 has an additional offset portion 41 towards the second side 15. In another embodiment, the pin 5 rests continuously against the base wall 13 outside of the offset portion 37. The offset portion 41 provides a mechanism for determining the position of a portion of the pin 5 projecting out of the contact body 3.

The contact body 3 has a first pin contact securing portion 43 positioned proximate to the conductor connecting portion 33, extending against the insertion direction S. The first pin contact securing portion 43 secures the pin contact 1 within a complementary electrical connector housing (not shown). The housing may include a complementarily blocking element with which the first pin contact securing portion 43 can be brought into contact so that movement of the pin contact 1 within the electrical connector housing against the mating direction S is prevented.

The contact body 3 has a mating end portion 45 formed from the second outer wall 23, positioned proximate to the mating end 4. The mating end portion 45 includes a second pin contact securing portion 47. The second pin contact securing portion 47, like the first pin contact securing portion 43, may be used to secure the pin contact 1 within the electrical connector housing. The connecting end of the cantilevered arm 25 is attached to the mating end portion 45, with the free end 27 extending obliquely away from the base wall 13 and mating end portion 45, and against the insertion direction S.

The reinforcing bridge 49 extends obliquely from the second outer wall 23, towards the base wall 13, and is a member of the mating end portion 45 positioned beneath the cantilevered arm 25. The reinforcing bridge 49 extends longitudinally against the insertion direction S to the first pin contact securing portion 43. The reinforcing bridge 49 reduces deformation of the mating end portion 45 by an applied force in the insertion direction exerted upon the positioning surface 31 of the free end 27. In this way, the cantilevered arm 25 can exert a greater outward force, without adversely effect on the pin contact 1 positioning within the electrical connector housing.

The reinforcing bridge 49 is formed monolithically from the second outer wall 23, extending continuously therefrom. The reinforcing bridge 49 has a ridge 51 on an inner surface extending inward towards the welding region 35. Proximate to the ridge 51, the reinforcing bridge 49 additionally includes a recess 53. A tool receiving channel K is formed through the recess 53, extending from an outside A of the contact body 3 to an outer surface 36 of the offset wall 9 facing outward, away from the welding region 35. The tool receiving channel K is described in more detail with reference to FIGS. 1 and 3. In another embodiment, the reinforcing bridge 49 includes only one ridge 51 or just one recess 53 for this purpose. The ridge 51 and the recess 53 lie in longitudinal direction L at the level of the welding region 35, projecting into the pin receiving space 7, towards the offset portion 37 of the pin 5 offset in the direction of the offset wall 9.

Figure 3:
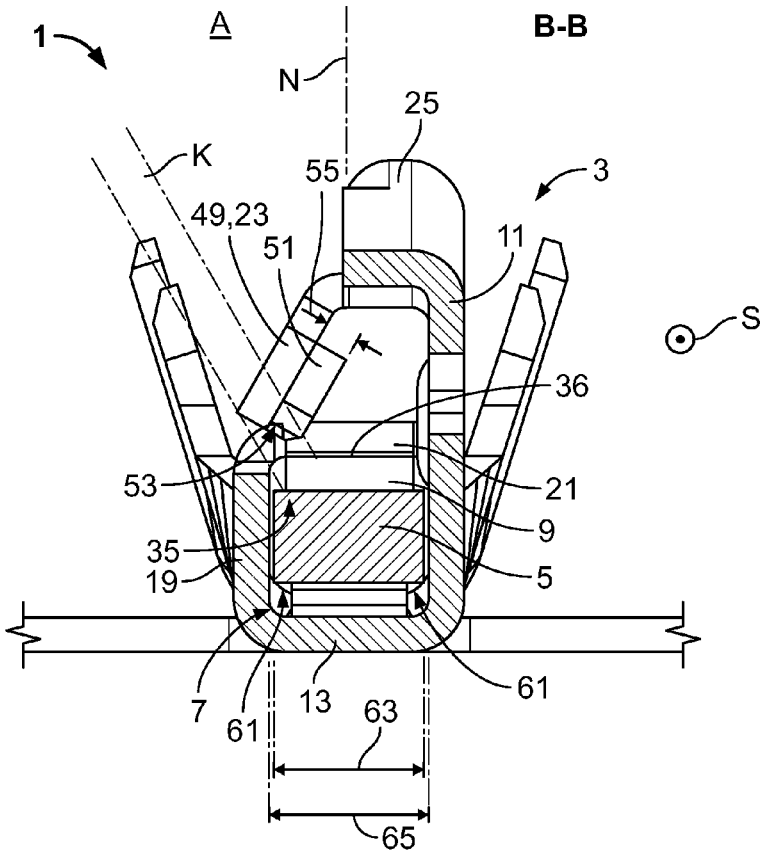
FIG. 3 is a cross-sectional view of the pin contact through the reinforcing bridge, along the line B-B.

In the embodiment of FIG. 3, sectional plane B-B extends through the reinforcing bridge 49 in the region of the ridge 51 and the recess 53.

The ridge 51 projects from the inner surface of the second outer wall 23 towards the pin 5. The recess 53 extends at the end of the reinforcing bridge 49 pointing towards the pin 5 in the region of the ridge 51. The ridge 51 and the recess 53 define the continuous and straight tool receiving channel K from outside A of the contact body 3 to the outer surface 36 of the offset wall 9 extending towards the welding region 35. The tool receiving channel K is positioned proximate to the cantilevered arm 25.

The tool receiving channel K extends approximately at an angle of 30° to a vertical axis N which extends perpendicular to the longitudinal axis and intersects an approximate middle of the base wall 13. In an embodiment, the tool receiving channel K can also run parallel to the vertical axis N or at some other desired angle, depending upon the tooling technique used. The tool receiving channel K is restricted to the base wall 13 by the adjacent sidewall 19. A ridge thickness 55 of the ridge 51 and a recess width of the recess 53 accordingly determine the dimensions of the tool receiving channel K.

The reinforcing bridge 49 and the second inner wall 21 are formed from the end sections 59 of the metal sheet 11. The reinforcing bridge 49 extends substantially parallel to the cantilevered arm 25. The tool receiving channel K, defined by the ridge 51 and the recess 53, is positioned at the level of the welding region 35 as viewed in the insertion direction S.

The cantilevered arm 25 is disposed adjacent to the reinforcing bridge 49 as viewed in the insertion direction S.

The offset wall 9 of the second inner wall 21 projects into the pin receiving space 7 such that the offset wall 9 presses against the pin 5 when the pin 5 is inserted into the pin receiving space 7. Likewise, the offset portion 37 of the pin 5 projects toward the offset wall 9. Secure mechanical and electrical contact between the offset wall 9 and the pin 5 is established through contact of the offset portion 37 of the pin 5 and the offset wall 9 of the second inner wall 21. A widening portion 61 of the inserted pin 5 within the welding region 35 has a greater diameter than the rest of the pin 5. The increased diameter of the widening portion 61 serves to increase the width 63 of the pin 5 positioned in the welding region 35 to be approximately equal to an inner width 65 of the pin receiving space 7.

In a region of the contact body 3 surrounding the pin 5, the contact body 3 has a profile without any axes of symmetry. This is achieved by the end section 59 that has the reinforcing bridge 49 extending obliquely towards the base wall 13 and not in a straight line parallel to the sidewalls 19. The profile of the contact body 3 in the region surrounding the pin 5 thus serves as security against faulty insertion when introducing the pin contact 1 into a complementary housing, since pin receiving spaces on the housing must be complimentary to the profile of the contact body 3.

Figure 4:
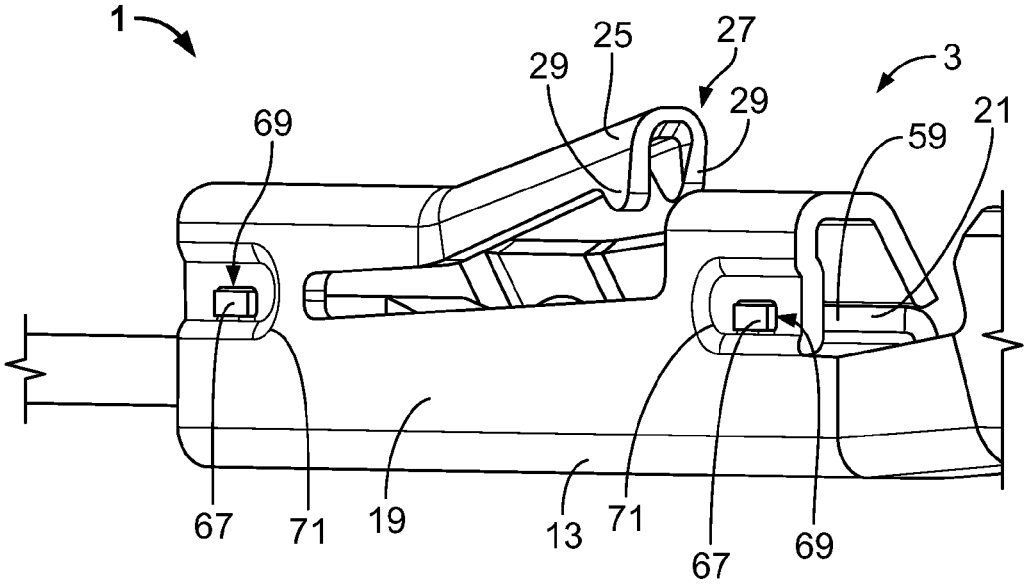
FIG. 4 is a perspective view of the contact body.

In the embodiment of FIG. 4, the cantilevered arm 25 has the limiting protrusions 29 extending towards the base wall 13. At the free end 27 the cantilevered arm 25 has a U-shaped profile, the opening of which extends towards the base wall 13. If the cantilevered arm 25 is deflected towards the base wall 13, for example when inserting the pin contact 1 into the complementary housing (not shown), the limiting protrusions 29 limit the degree of deflection the limiting protrusions 29 contact the second inner wall 21 and prevent further deflection.

The stability of the contact body 3 is increased through the second inner wall 21, which has securing projections 67 on the end section 59. The securing projections 67 extend into projection receiving openings 69 positioned in the opposite sidewall 19. So that the securing projections 67 do not project outward from the contact body 3, the opposite sidewall 19 has indentions 71, into which the projection receiving openings 69 are specifically positioned.

Figure 5:
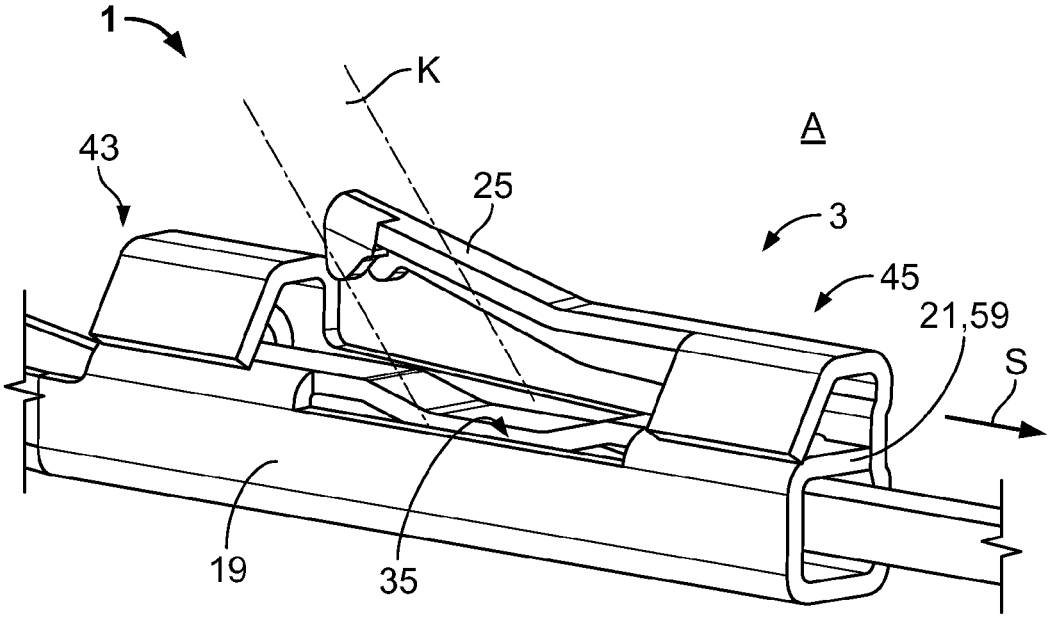
FIG. 5 is a perspective illustration of a pin contact and a contact body.

In FIG. 5, an embodiment of the pin contact 1 without the reinforcing bridge 49 is shown. The cantilevered arm 25 extends from the connecting end, detached, from the mating end portion 45, against the insertion direction S. This embodiment is used if the cantilevered arm 25 only needs to withstand small pull-out forces. By reducing the material used to form the pin contact 1, one can save on material and production steps. Furthermore, improved access to the welding region 35 is achieved, because the tool receiving channel K is only defined by the cantilevered arm 25 and the sidewall 19 the end section 59, of which forms the second inner wall 21. As in the above embodiment, the cantilevered arm 25 extends against the insertion direction S at the level of the welding region 35 and obliquely away from the contact body 3 to the outside A.

Figure 6:
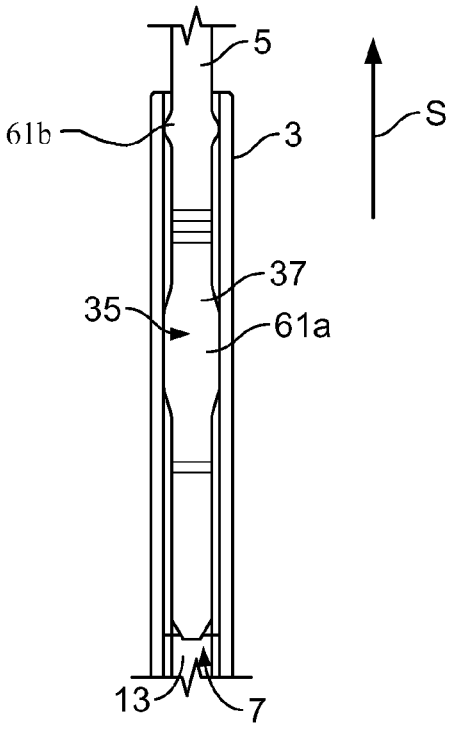
FIG. 6 is a cross-sectional view along a longitudinal axis of a pin positioned in the pin contact.

In the embodiment of FIG. 6, a longitudinal cross-section through a pin 5 in a contact body 3 parallel to the base wall 13 is shown. The pin 5 has first widening portion 61*a* and a second widening 61*b*. The first and second widening portions 61*a*, 61*b* extend transversely to the insertion direction S and parallel to the base wall 13. The first widening portion 61*a*, discussed above, is positioned proximate to the welding region 35, and the second widening portion 61*b* is spaced apart from the first widening portion 61*a*, and positioned proximate to the mating end 4 of the pin contact 1. By using two widening portions 61*a*, 61*b* spaced a distance apart from each other, pivoting of the pin 5 in the pin receiving space 7 prevented, such that the position of the pin 5 relative to the contact body 3 is secured before a welding process. The first widening portion 61*a* in the region of the welding region 35 has a greater length along the insertion direction S, than the second widening portion 61*b*, extending substantially along the length of the offset portion 37. In this way an electrical contact between the pin 5 and the offset wall 9 is improved because the area of the contacting surface between the pin 5 and the offset wall 9 is increased.

Figure 7:
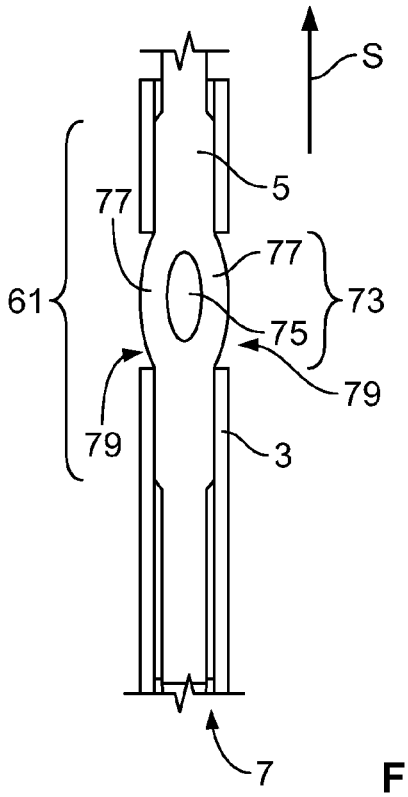
FIG. 7 is a cross-sectional view of the pin contact.

In the embodiment of FIG. 7, the pin 5 is positioned in the contact body 3, and has a single widening portion 61 with a broadening zone 73 in an approximate middle. In the broadening zone 73, the width of the pin 5 is greater than the remaining length of the single widening portion 61. Moreover, in the broadening zone 73, the pin 5 may have a central opening 75. The pin 5 extends in the form of two opposing arms 77 which define the central opening 75. The arms 77 can be elastically deflected transversely to the insertion direction S, such that upon inserting the pin 5 in the pin receiving space 7, the arms 77 can be bent towards one another into the contact body 3.

The contact body 3 has two opposing broadening zone receiving openings 79 in the sidewalls 19, into which the broadening zone 73 of the pin 5 can be inserted. If a pin 5 is pushed into the contact body 3, the arms 77 are deflected towards one another and splay as soon as the broadening zone 73 is positioned at the level of the broadening zone receiving openings 79. The pin 5 then is positioned with broadening zone 73 in the pin receiving space 7.

What is claimed is:

1. A pin contact for an electrical connector comprising:
a contact body formed from a metal sheet and having
a mating end,
a pin receiving space extending inward from the mating end,
an offset wall having at least one welding region and an outer surface facing away from the welding region and accessible through a tool receiving channel extending linearly from the outer surface to outside the contact body, and
an overlapping inner wall and an outer wall, both walls positioned on a side of the contact body, the outer wall having at least one cantilevered arm; and
a pin positioned in the pin receiving space and projecting out of the mating end, and being welded to the welding region.

2. The pin contact of claim 1, wherein the welding region of the offset wall extends a distance into the pin receiving space.

3. The pin contact of claim 1, wherein the offset wall is formed from a portion of the inner wall.

4. The pin contact of claim 3, wherein the inner wall and the outer wall are formed from opposite end sections of the metal sheet.

5. The pin contact of claim 1, wherein the outer wall is spaced apart from the inner wall.

6. The pin contact of claim 1, wherein the tool receiving channel is positioned proximate to the cantilevered arm.

7. The pin contact of claim 1, wherein the cantilevered arm is positioned at the level of the welding region, extending along a longitudinal axis.

8. The pin contact of claim 1, wherein an end section of the outer wall forms a reinforcing bridge extending substantially parallel to the cantilevered arm.

9. The pin contact of claim 8, wherein the reinforcing bridge partially surrounds the tool receiving channel.

10. The pin contact of claim 9, wherein the reinforcing bridge has a ridge on an inner surface, the ridge defining a first portion of the tool receiving channel.

11. The pin contact of claim 10, wherein the reinforcing bridge further comprises a recess defining a second portion of the tool receiving channel.

12. The pin contact of claim 11, wherein the ridge and the recess taken together, define the tool receiving channel.

13. A pin contact for an electrical connector comprising:
a contact body formed from a metal sheet and having
a mating end,
a pin receiving space extending inward from the mating end,
an offset wall having at least one welding region and an outer surface facing away from the welding region and accessible from the outside, and
an overlapping inner wall and an outer wall, both walls positioned on a side of the contact body, the outer wall having at least one cantilevered arm; and
a pin positioned in the pin receiving space, projecting out of the mating end, welded to the welding region, and having an offset portion extending toward and contacting the offset wall.

14. A pin contact for an electrical connector comprising:
a contact body formed from a metal sheet and having
a mating end,
a pin receiving space extending inward from the mating end,
an offset wall having at least one welding region and an outer surface facing away from the welding region and accessible from the outside, and an overlapping inner wall and an outer wall, both walls positioned on a side of the contact body, the outer wall having at least one cantilevered arm; and a pin having at least one widened portion positioned in the pin receiving space, the pin projecting out of the mating end and being welded to the welding region.

* * * * *